US008965023B2

(12) United States Patent
Wolfe

(10) Patent No.: US 8,965,023 B2
(45) **Date of Patent: *Feb. 24, 2015**

(54) GARMENT WITH BUILT-IN AUDIO SOURCE WIRING

(71) Applicant: Jerry Leigh of California, Inc., Van Nuys, CA (US)

(72) Inventor: James Wolfe, Venice, CA (US)

(73) Assignee: Jerry Leigh of California, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/841,257

(22) Filed: Mar. 15, 2013

(65) Prior Publication Data

US 2014/0112521 A1 Apr. 24, 2014

Related U.S. Application Data

(63) Continuation-in-part of application No. 13/340,388, filed on Dec. 29, 2011, which is a continuation of application No. 12/978,516, filed on Dec. 24, 2010, now Pat. No. 8,553,919, which is a continuation-in-part of application No. 12/896,880, filed on Oct. 2, 2010, now Pat. No. 8,687,834, which is a continuation-in-part of application No. 12/492,035, filed on Jun. 25, 2009, now Pat. No. 8,107,653.

(51) Int. Cl.

| | |
|---|---|
| ***H04R 25/00*** | (2006.01) |
| ***H04R 1/10*** | (2006.01) |
| ***A41D 1/00*** | (2006.01) |
| ***H04R 1/02*** | (2006.01) |

(52) U.S. Cl.

CPC ..... *H04R 1/1033* (2013.01); *A41D 1/005* (2013.01); *H04R 1/028* (2013.01); *H04R 1/1016* (2013.01); *H04R 2201/023* (2013.01); *H04R 2420/07* (2013.01)

USPC ..... 381/333; 381/301; 381/384

(58) Field of Classification Search

CPC .... H04R 1/1033; H04R 1/028; H04R 1/1016; H04R 2201/023; H04R 2420/07; A41D 1/005

USPC ..... 381/300, 301, 309, 333, 370, 374, 376, 381/385, 388; 2/69, 209, 209.13, 905, 906; 379/430; 455/100, 575.1, 575.6; 181/129, 130, 135

See application file for complete search history.

(56) References Cited

U.S. PATENT DOCUMENTS

| | | | | |
|---|---|---|---|---|
| 7,684,755 | B2 * | 3/2010 | Pierce et al. | 455/41.2 |
| 8,107,653 | B2 * | 1/2012 | Wolfe | 381/301 |
| 8,411,891 | B2 * | 4/2013 | Del Prete | 381/333 |
| 8,553,919 | B2 * | 10/2013 | Wolfe | 381/333 |
| 8,687,834 | B2 * | 4/2014 | Wolfe | 381/333 |

* cited by examiner

*Primary Examiner* — Huyen D Le

(74) *Attorney, Agent, or Firm* — Lawrence S. Cohen

(57) ABSTRACT

An audio source system may be built into a garment to provide wiring from an audio source to earplugs. The wiring is brought from a point of connection to the audio source such as at a pocket and is then brought to the garment opening by tubes such as may be sewn with normal seams in construction of the garment such as side seams, sleeves seams and shoulder seams, and then into a channel at the opening, which may be a simple neck opening or a collared opening or a hood (in which the channel extends around the hood opening). An auxiliary wiring may be connected to allow a second hearing device such as ear buds or earphones. Wiring may be equipped with spring biased coils to allow stretching.

22 Claims, 20 Drawing Sheets

GARMENT WITH BUILT-IN AUDIO SOURCE WIRING

This application is a continuation-in-part of application Ser. No. 13/340,388 filed on Dec. 29, 2011, which is a continuation of U.S. application Ser. No. 12/978,516 filed on Dec. 24, 2010, which is a continuation-in-part of U.S. application Ser. No. 12/896,880 filed on Oct. 2, 2010 which is a continuation-in-part of U.S. application Ser. No. 12/492,035 filed on Jun. 25, 2009 the content of which is incorporated herein by reference and the priority of which is claimed.

FIELD OF THE INVENTION

The invention is in the fields of clothing and wiring for listening to portable audio sources such as MP3 players, CD players, cell phones, Bluetooth devices and the like. In particular for combinations of clothing and such wiring.

BACKGROUND

Wiring assemblies for portable audio sources for listening are ubiquitous. They are generically called headphones. One type of headphones adapted for portable use are called earbuds or earphones. They have at one end a connector to plug into a source device. This then leads to a pair of wires connected to the devices to be placed at the user's ears, usually held in or on the ear.

A user carries the wiring assembly with her and connects it up to the source device and sets the headphones at the ears. The wiring has to be carried and kept available for use, and it is commonly a nuisance to find it and then to use it. In use it is kept usually outside the clothing, the headphones being at the ears and the audio device held in the hand or placed in a pocket.

The wiring may not be waterproof, but recently waterproof wiring has been developed and is available.

Certain special problems are presented with hooded garments designed for children due to the danger of choking presented by lanyards for cinching and cinching in general. To provide such a garment with an audio system presents special problems.

DETAILED DESCRIPTION OF THE INVENTION

In the present invention wiring for an audio device, including headphones and earphones are permanently installed into a garment.

Figure 1:
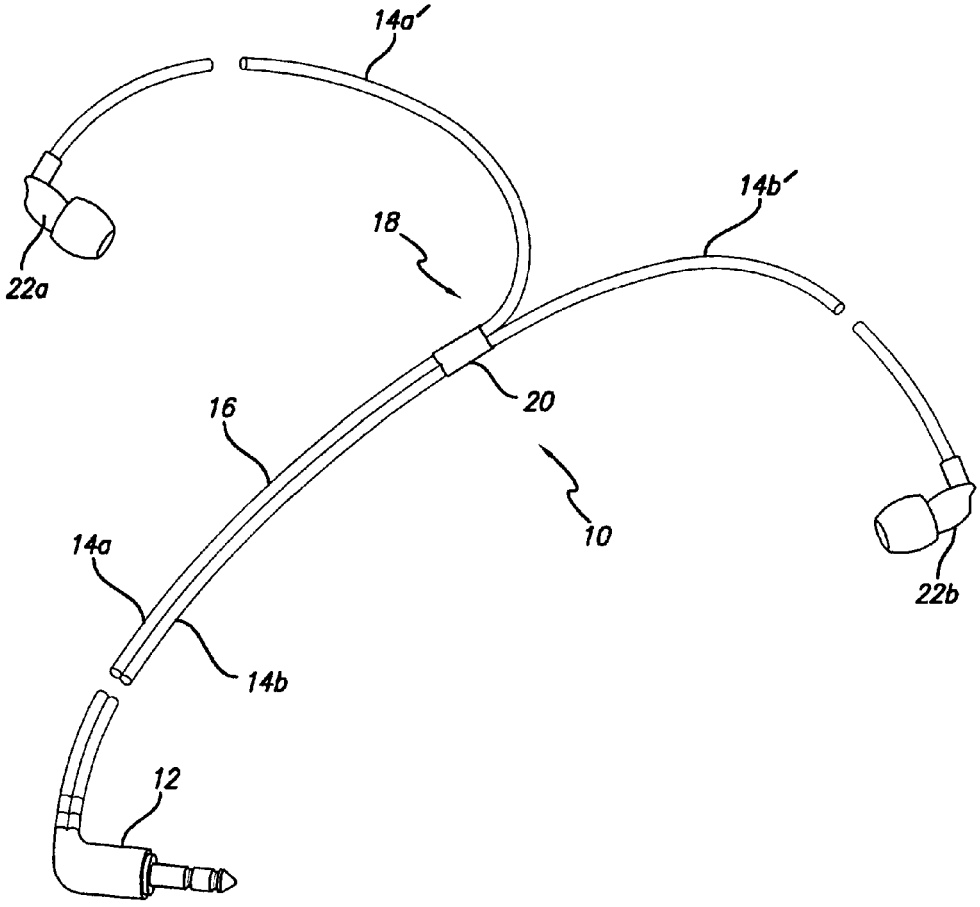
FIG. 1 is a view of an exemplary type of earphones and wiring which is applicable to the present invention.

An exemplary earphone wiring assembly 10 as in FIG. 1 is of the type including a connector 12 for connecting to an audio source device, typically with paired analog audio transmission wires 14*a* and 14*b* joined together along a joined wire portion 16 for some distance to a separation point 18 typically having a strain relief member 20 from which the transmission wires 14*a*' and 14*b*' extend separately terminating at the earphones 22*a* and 22*b*. While the term earphone wiring will be used in this description it is intended to mean any of the type with a connection to a source device and a pair of listening instruments, one for each ear. Typically an analog signal travels from the source device to the earphones.

Figure 2:
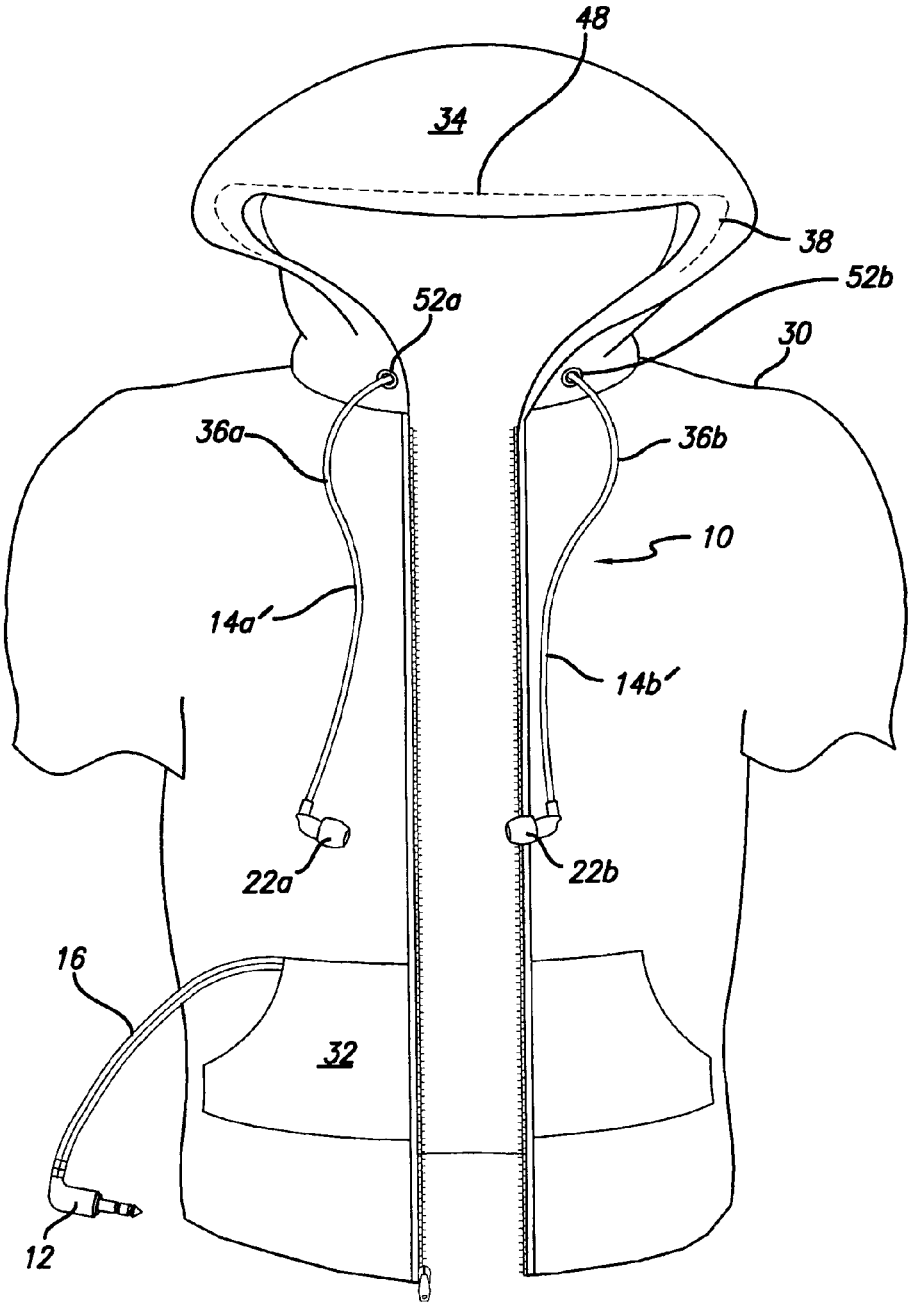
FIG. 2 shows a front view of a hooded garment with earphone wiring built into it according to an embodiment of the invention.
Figure 3:
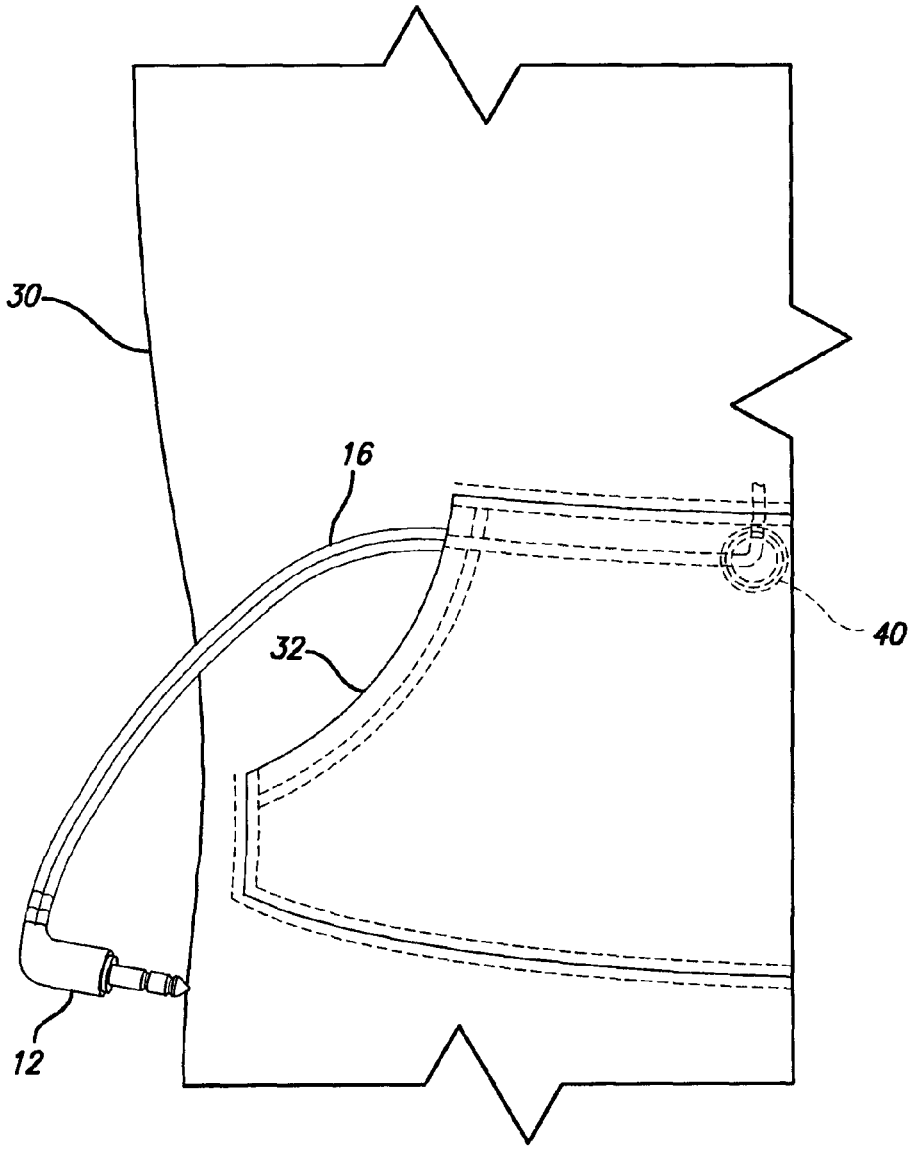
FIG. 3 shows a partial view of a garment showing the connector and access wiring extending into a garment pocket.

In exemplary form the garment is a hooded garment 30 as shown in FIG. 2. In other exemplary forms the garment is a conventionally collared shirt, and in still others it has a plain hemmed neck such as a crew neck. In the case of the hooded garment, it may be in jacket form, that is open down the front (with a zipper or other closure means) or in pull-over form like a sweater. However in each case for purposes of embodiments of this invention there is a channel or casing as will be described. In this description the terms left and right refer to the wearer's left and right. As shown in FIG. 2, the earphone wiring 10 is installed into the garment so that the connector 12 is accessible near a pocket 32 and the right and left earphone wires 14*a*' and 14*b*' exit the garment inside hollow lanyards (also called drawstrings) 36*a* and 36*b* on each side of the hood 34 near the user's ears terminating at the right and left earphones 22*a* and 22*b*. As will be described in more detail below, the portions of the earphone wiring 10 from the connector 12 to which access is not needed and which runs up to the hood 34 is captured in the garment. Also shown in FIG. 2 are right and left tubular lanyards 36*a* and 36*b*. These are used to cover the earphone wires 14*a*' and 14*b*' and also as the hood lanyards, for adjusting (called cinching) the hood 34. The hollow lanyards are knitted or may be hollow flexible plastic FIG. 3 shows an example of how the wire portion 16 extends into the pocket 32 and exits the inner wall of the pocket 32 through an opening 40 so that it is in the inside of the garment 30, as further described below with reference to FIG. 4

Figure 4:
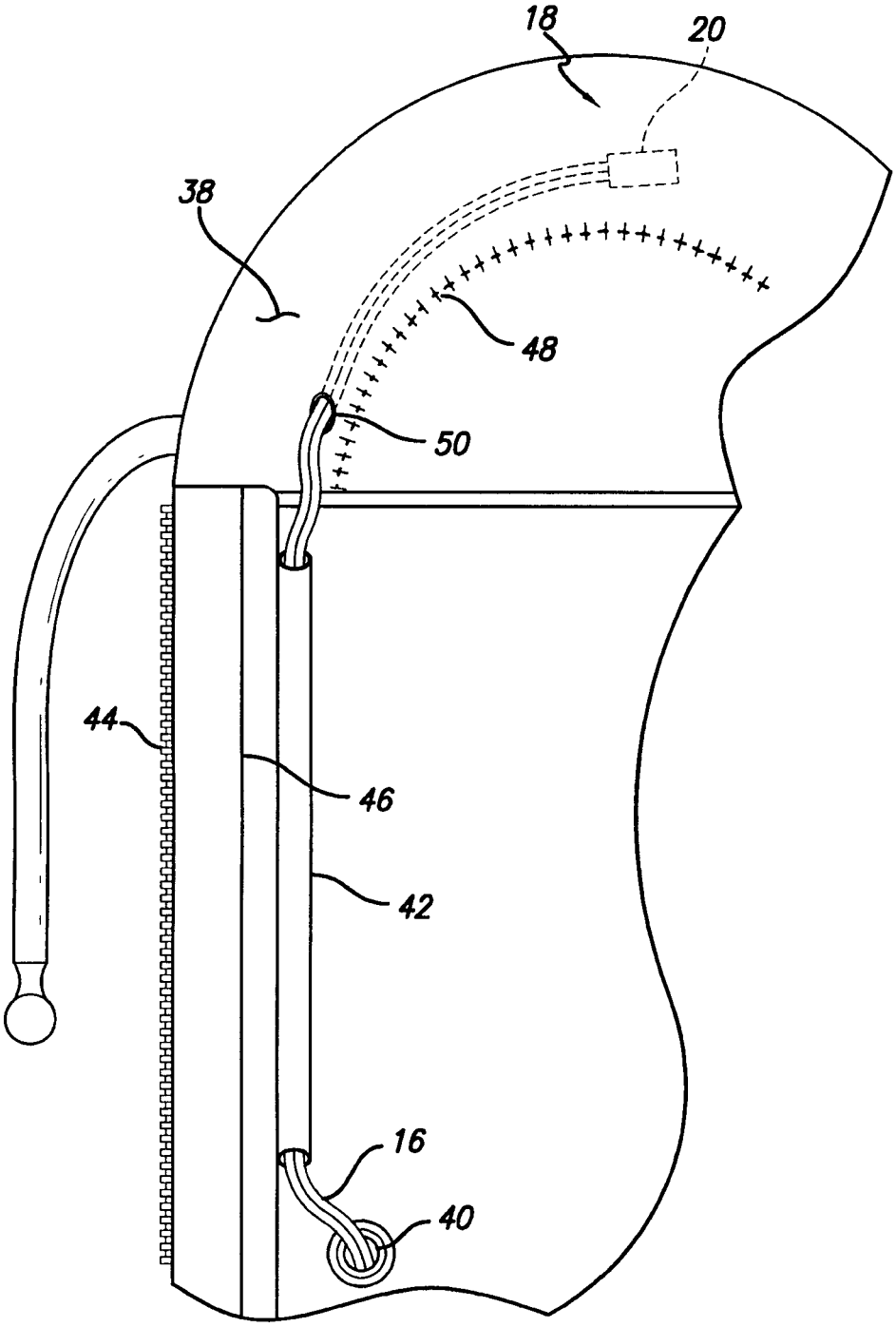
FIG. 4 shows a partial view of a garment with the wiring in a tube sewn into the inside of a garment and entering the channel of the hood.

FIG. 4 shows an example of how the earphone wiring 16 is brought from a location inside the pocket 32 into the hood channel 38. This is done by passing the joined wire portion 16 through an opening 40 inside the pocket, which opening can be a button hole or a grommet to the inside of the garment. Then it enters a first, lower end of and travels through a channel or casing 42 which is sewn into the inside of the garment, in this case along the stitch line 46 that also attaches a zipper 44. Then it exits the channel 42 at a second, upper end, and enters the hood channel 38 (also called a casing) which is defined by the stitching 48, through an opening 50 defined by a button hole or other hole device such as a grommet, entering on the side of the hood channel 38 which is on the interior of the hood 34 and extends to the separation point 18 at which the wires separate. Further detail inside the hood channel 38 is described below.

Installation of the wiring can be done with a garment that does not have a pocket, in which case the wiring can simple extend beyond the bottom of the garment, or it can pass through an opening in the garment.

Figure 5:
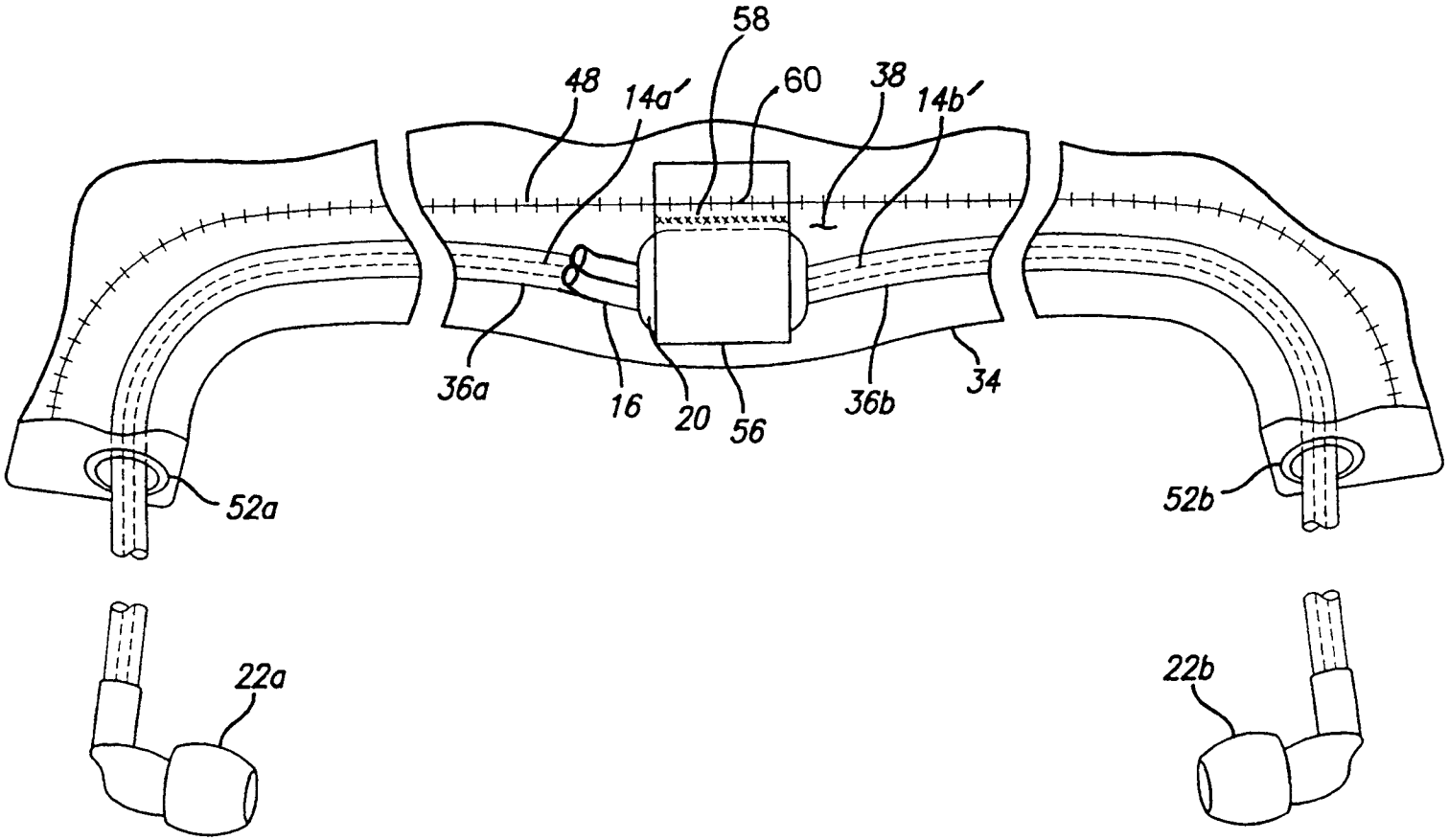
FIG. 5 shows a partial view of a garment with a hood showing a cut-away view of the interior of the inside the channel of the hood with the wiring.

FIG. 5 shows a view of the inside of the hood channel 38 with a portion cut-away to show the interior of the channel. The joined portion 16 comprising the wires 14*a* and 14*b* enters the hood channel 38 as described above with reference to FIG. 4, and this portion is placed so that the strain relief member 20 at which they separate is approximately at the center of the hood 34. The right and left separate wires 14*a*' and 14*b*' are installed inside the right and left hollow lanyards 36*a* and 36*b* respectively. The assembly at the point where the wires 14*a*' and 14*b*' exit the strain relief 20 into the hollow lanyards 36*a* and 36*b* is described in FIGS. 6-8 below. The right and left hollow lanyards 36*a* and 36*b* with the right and left wires 14*a*' and 14*b*' respectively, inside them exit the hood channel 38 through openings 52*a* and 52*b*, which in this embodiment are on the outside of the hood channel 38, although they could be on the inside.

Figure 6:
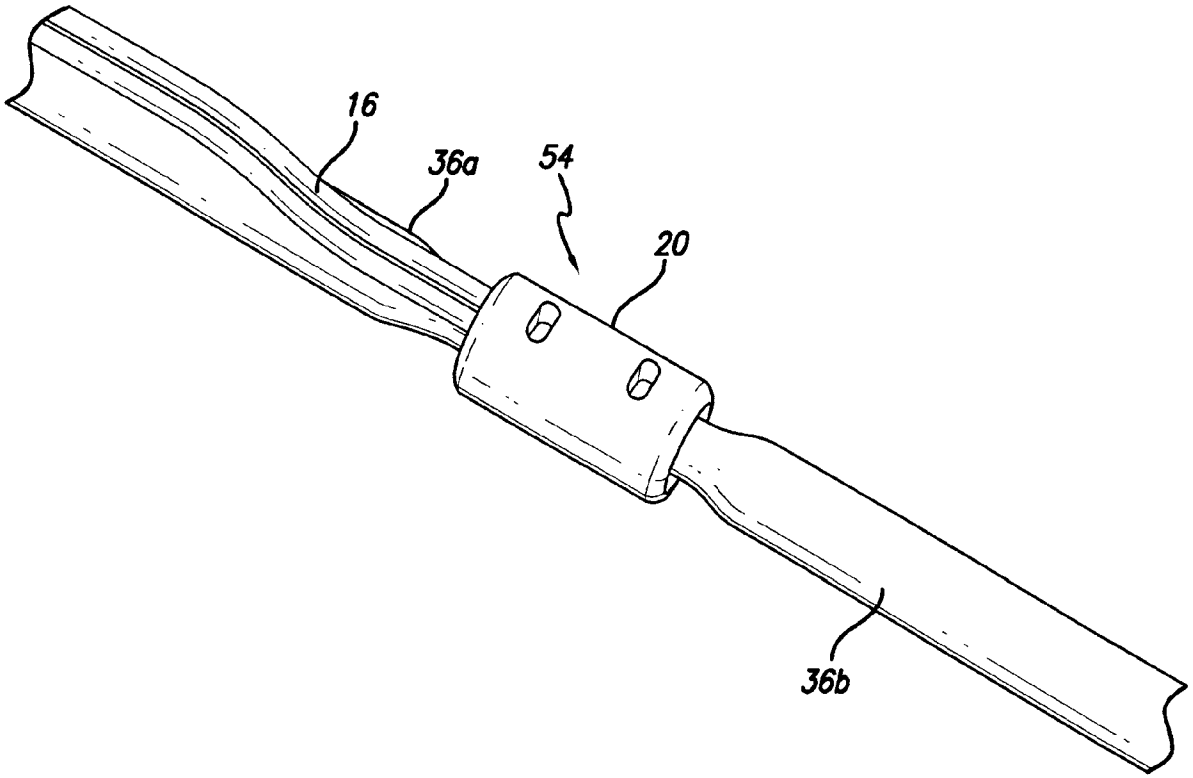
FIG. 6 shows the wiring and hollow lanyards as held together in the channel by a barrel.

FIG. 6 shows an embodiment for a secure "Y" connection of the wires inside the hood channel 38. In this embodiment the strain relief also called a securing piece 20 is a plastic barrel that has been molded over the separation point 18 where the joined wires 14*a* and 14*b* separate into the separate wires 14*a*' and 14*b*'. It is also at this point that the wires 14*a*' and 14*b*' enter the hollow lanyards 36*a* and 36*b* respectively. The securing device 20 tightly holds the ends of the lanyards with respect to each other and the wires. This will be referred to as the securing point 54.

Figure 7:
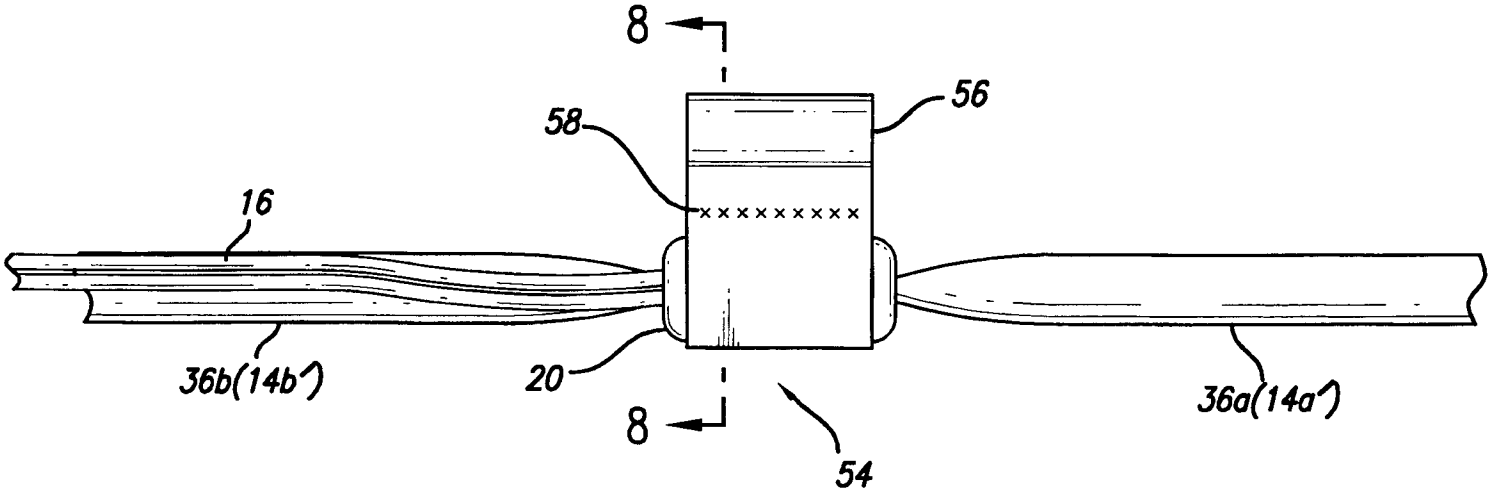
FIG. 7 is a view showing the wiring and hollow lanyards with a tab attached to the barrel for fixing to the garment.
Figure 8:
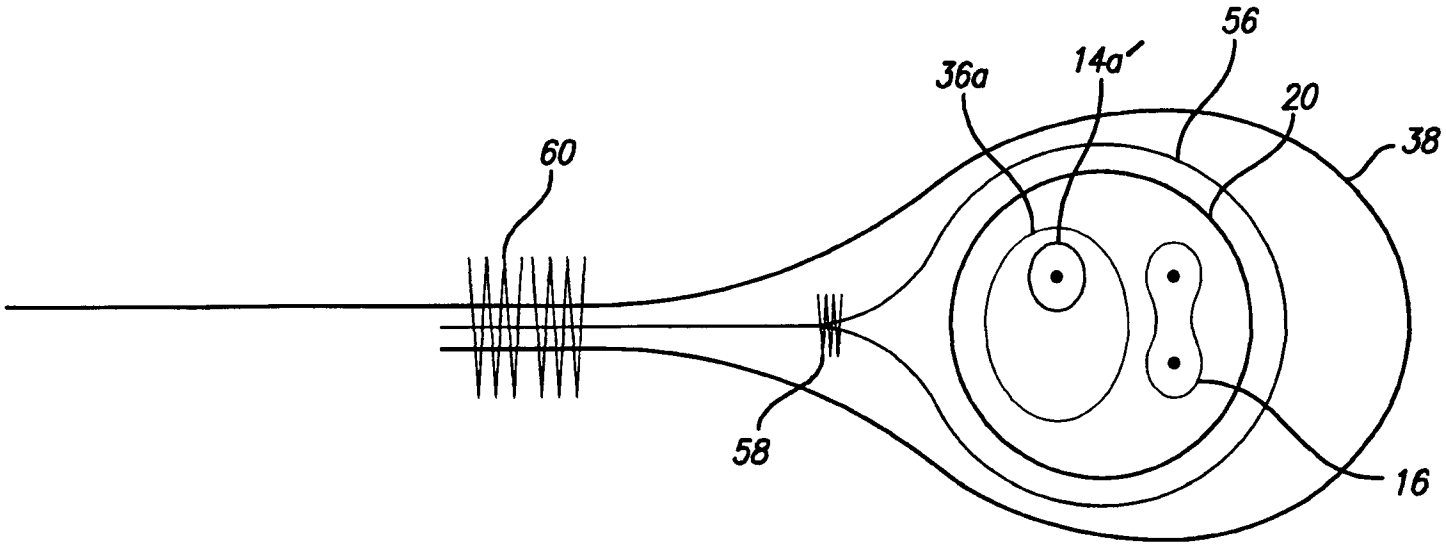
FIG. 8 is a section view at 8-8 of FIG. 7 showing the wiring and hollow lanyards fixed to the casing by means of the tab.

It is preferable that the lanyards 36*a* and 36*b* with the wires inside them be attached to the garment inside the hood channel 38 to avoid pulling them laterally in one direction or the other such as by uneven pulling. There are various ways that this can done. One way is to secure the assembly to the garment at or near the securing point 54. In one embodiment this is done as shown in FIGS. 5, 7 and 8 with a fabric strip 56 secured around the securing piece 20, stitching and gluing being exemplary. It is then co-sewn into the hem stitch 46 which defines the casing or channel 38. The detail is shown in FIG. 8 in which the fabric strip 56 is sewn at 58 to help secure it around the securing piece 20. Then, after it has been set in place, it is co-sewn with the hood channel hem as shown at 60.

Figure 10:
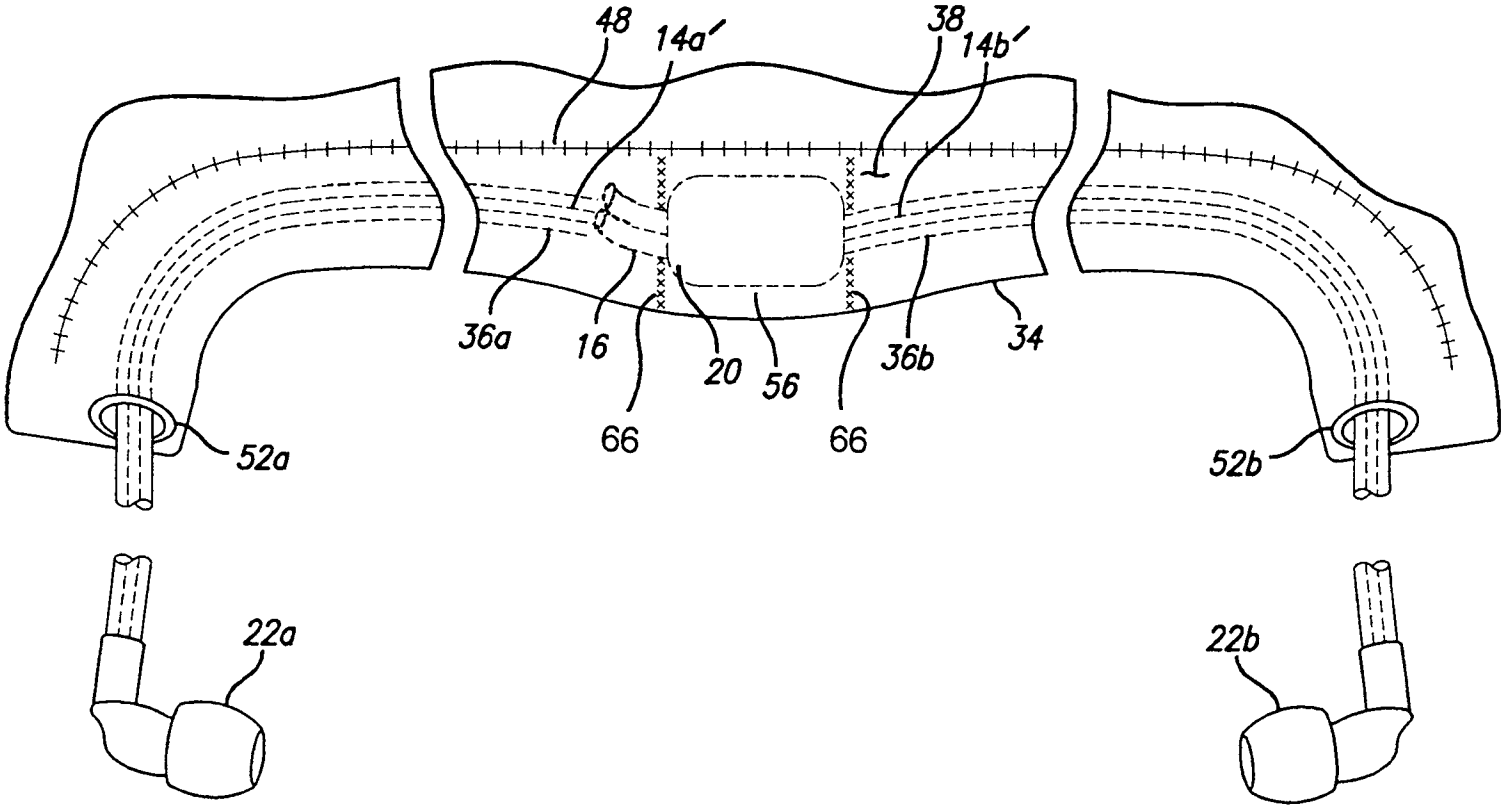
FIG. 10 is a view of the channel portion of a hooded garment showing the wiring inside it and an alternative way of fixing the wiring and lanyards against lateral movement.

FIG. 10 shows another embodiment for fixing the lanyard/wire members against lateral movement. In this embodiment, the securing piece 20 is captured between stitch lines 66 on either side. Of course the stitch lines 66 have to avoid the wiring.

As explained above, an embodiment of the invention combines the hood lanyards 36*a* and 36*b* with the separate wire portions 14*a*' and 14*b*' so that the hollow lanyards serve two purposes, one is to tighten the hood, and secondly as conduits for the separate wire portions 14*a*' and 14*b*'. The ends of the lanyards 36*a* and 36*b* are secured to the earphones 22*a* and 22*b*, which in the figures are shown as the earbuds type of earphones.

Figure 9A:
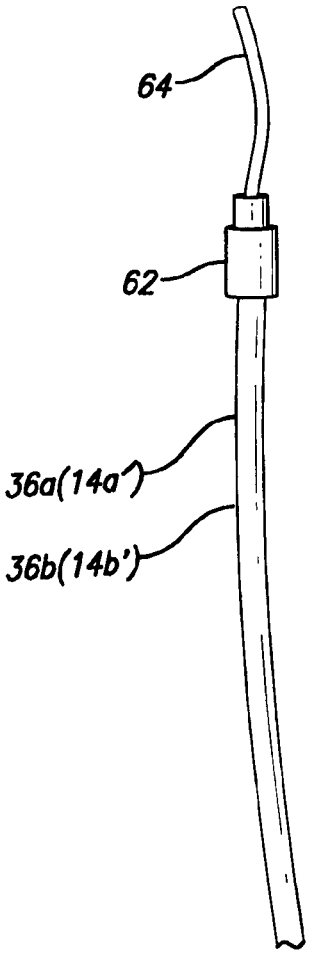
FIG. 9*a* is a view of the hollow lanyard with the electrical wire and a connection fitting for connection to an earbud.
Figure 9B:
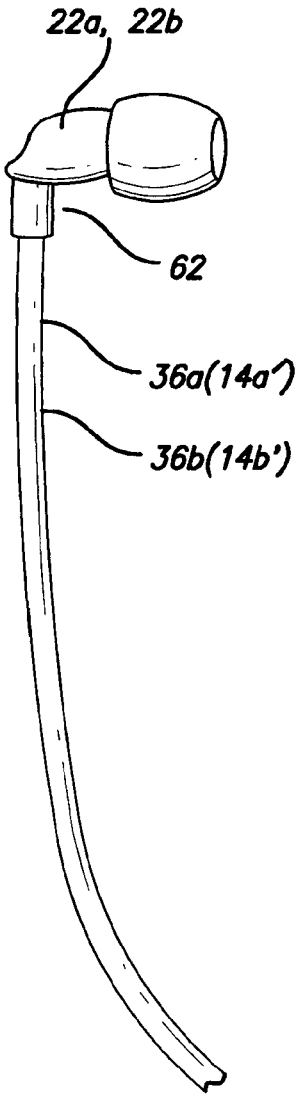
FIG. 9*b* is a view showing the assembled fitting to the earbud.

To manufacture the assembly so that the wiring is permanently installed in the garment, the separate wires 14*a*' and 14*b*' are first strung through the lanyards 36*a* and 36*b*. Then the molded barrel 20 is molded into place at the "Y" junction securing point 54 joining the wires and the lanyards at one end. Then the other ends of the combined lanyards and wires are crimped to a strain relief connection fitting 62 as shown in FIG. 9*a*, and then the stripped wire portion 64 is attached to the earbuds 22*a* and 22*b* and the connection fitting 62 is secured to the earbuds 22*a* and 22*b* as shown in FIG. 9*b*.

While in this description, the terms right and left have been used to understand the location of the lanyards, the wires and the earphones with respect to the garment; it should be understood that the location may but does not necessarily consistently apply to the attachment to a user's left and right ear. A user may attach the left earphone to the left ear and the right earphone to the right ear. But a user can elect to do the opposite; and when the lanyards are tied in a conventional bow, the left and right earphones will reverse their relative location.

Figure 11:
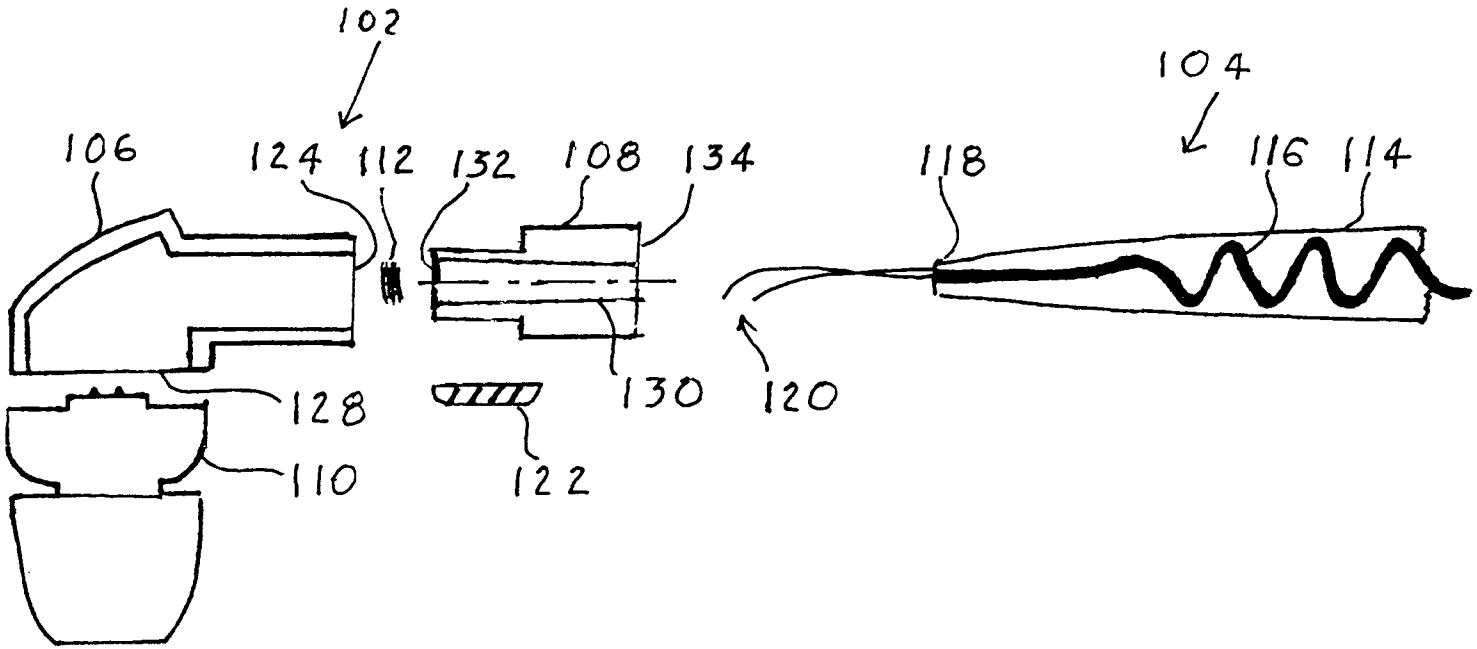
FIG. 11 is a schematic view of an embodiment of the invention ready for assembly.
Figure 12:
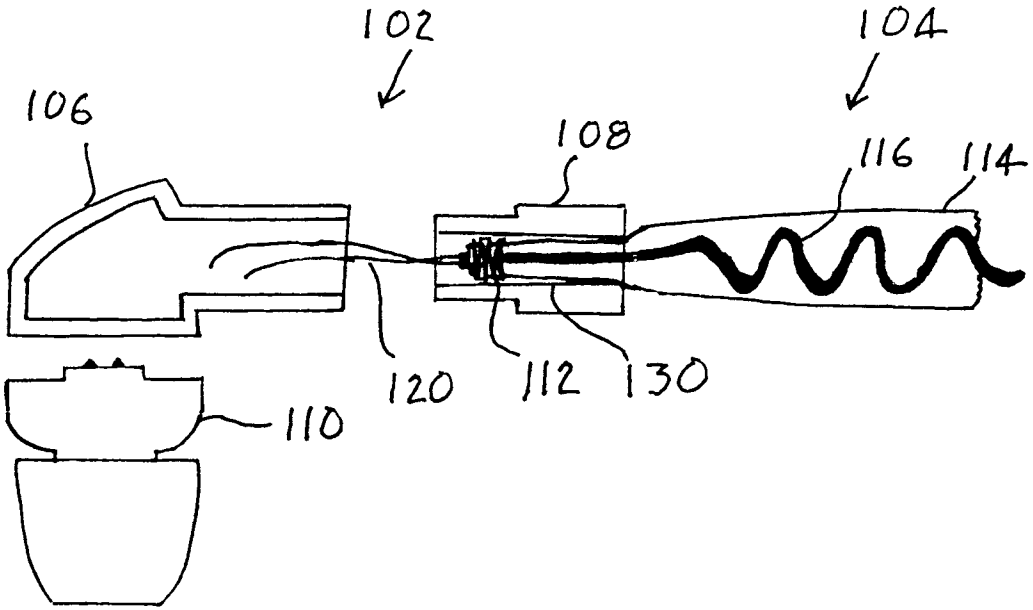
FIG. 12 is a schematic view of the embodiment of FIG. 11 showing partial assembly.
Figure 13:
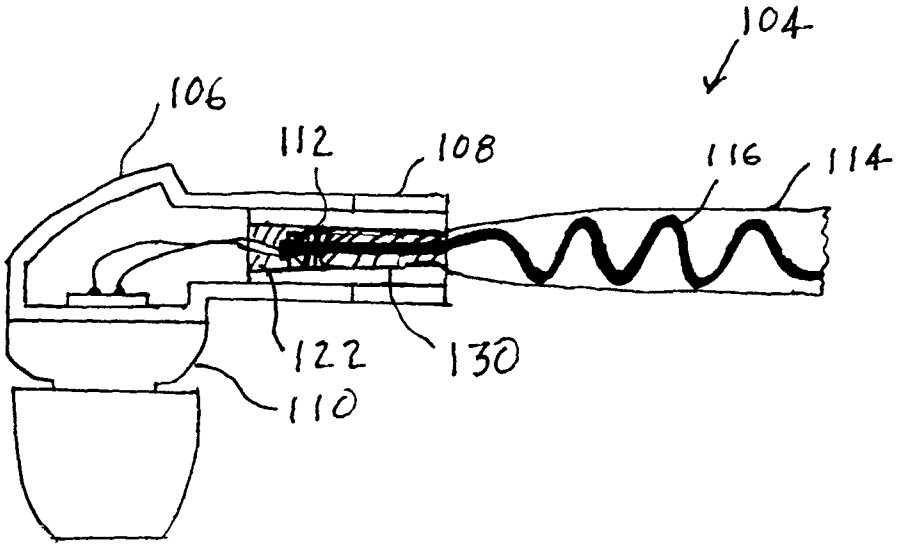
FIG. 13 is an assembled view of the embodiment of FIGS. 11 and 12.
Figure 14:
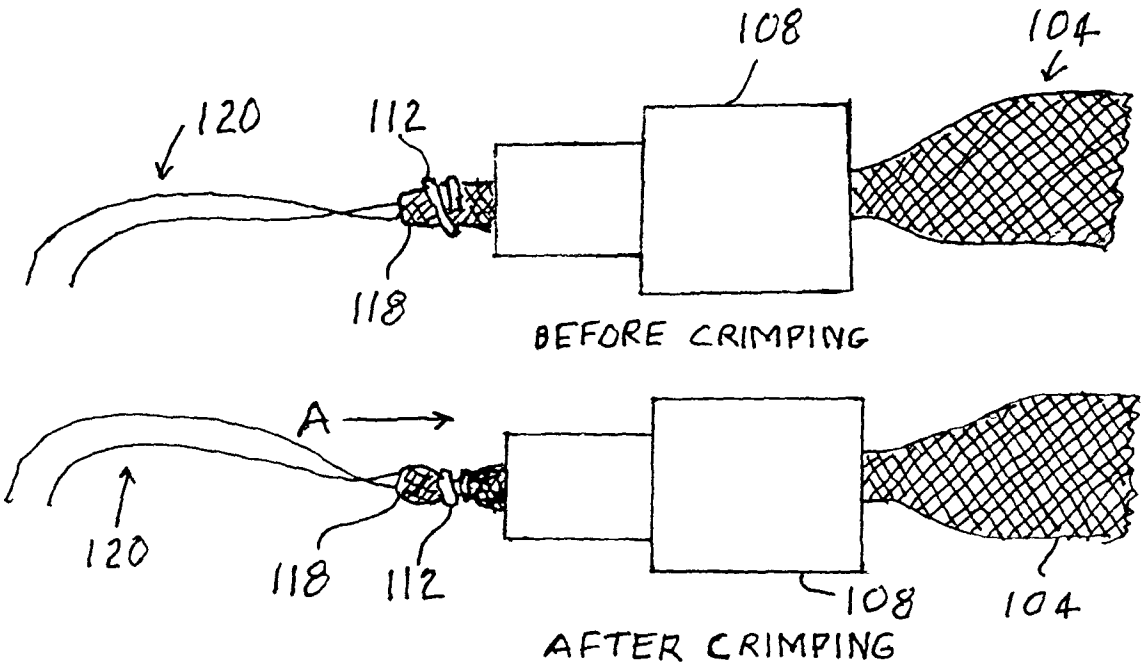
FIG. 14 is an enlarged detailed view of an embodiment of the invention of FIGS. 11, 12 and 13.

A further embodiment is shown in FIGS. 11, 12 and 13 which are progressive assembly and the enlarged views of FIG. 14. In FIG. 11 there are shown an earbud 102 ready for assembly to a lanyard assembly 104. The earbud is made up of a housing 106 a sleeve 108, (also seen as 62 in the description above) and a speaker or electronics assembly 110 and also a crimp element 112. The lanyard assembly 104 includes a lanyard 114 (described above as 36*a* and 36*b*), typically of woven construction and internal wiring 116 (described above as wires 14*a* and 14*b* on one side and 14*a*' and 14*b*' on the other side). Projecting beyond a terminal end 118 of the lanyard, the internal wiring 116, which consists of a two wire cable, has been stripped to provide bare wire 120 with terminal ends for connection to the speaker assembly 110. A glue drop is schematically illustrated at 122.

The housing 106 has a generally open interior and an opening 124 at its rear end to snugly, or interferingly receive the sleeve 108 and an opening 128 to receive the speaker assembly 110. The sleeve 108 has a passageway 130 through it from a front end 132 to a rear end 134. The passageway 130 may be tapered as shown from front to rear. Although it is shown as straight, the sleeve may have another shape with the passageway extending through it accordingly In FIG. 12 those same elements are shown partially assembled. To perform the assembly, the lanyard assembly 104 has been threaded through the sleeve 108 to extend beyond the front end 132. Then, the crimp element 112 in the form of coiled wire has been applied proximate the terminal end 118 of the lanyard assembly 104, and crimped. This can be seen in FIG. 14. The crimp element 112 secures the lanyard 104 and the wire 116 together so that they are fixed together at that point, that is there can be no relative movement between them and no movement of or force on the lanyard 114 is transmitted to the portions of the wires 120 that will be attached in the earbud speaker assembly 110. The crimping is also shown in enlarged form in FIG. 14 showing application of the crimp element 112 in the form of a coil of wire before and after crimping. More than one crimp element can be applied to ensure a secure crimp. Other elements can be used as the crimping element which can be closed or crushed down and will secure the lanyard 114 and the wire 120 against relative movement, for example a small lock-washer can be crimped in place. Then, the lanyard assembly 104 is pulled back (see the arrow A in FIG. 14) to pull the crimp element 112 into the passageway 130 where it is firmly captured by the wall of the passageway 130 with the bare wires 120 available for connection, as shown in FIG. 12. This is also shown in FIG. 9*a*. The wires 120 are attached to terminals of the speaker assembly 110 and glue 122 is applied into the passageway 130

The sleeve 108 is assembled to the housing 106 and the speaker 110 is assembled to the housing 106 where the parts are all fixed together by sonic welding. This final assembly is shown in FIG. 13 and also in FIG. 9*b*.

The wire 120 inside the lanyard 114 is slack as shown by the undulating portion whereby the combination of the slack and the crimping at the end allows any stretching of the lanyard 114 to be applied to the slack of the wire thereby freeing the wire from forces such a pulling on it put on the lanyard 114 and also prevents strain from communicating past the crimp point to the wires inside the housing. That means that as the user pulls on the lanyard such as to tie it or pull the hood tight, due to the slack, the wire 116 will not be subject any stretching or other forces caused by use of the lanyard. In other words, the wire 116 inside the lanyard 114 is independent of the lanyard 114 by reason of the slack and at the same time, the wires 120 beyond the crimp are also free of strain that might be caused by use of the lanyard.

Figure 15:
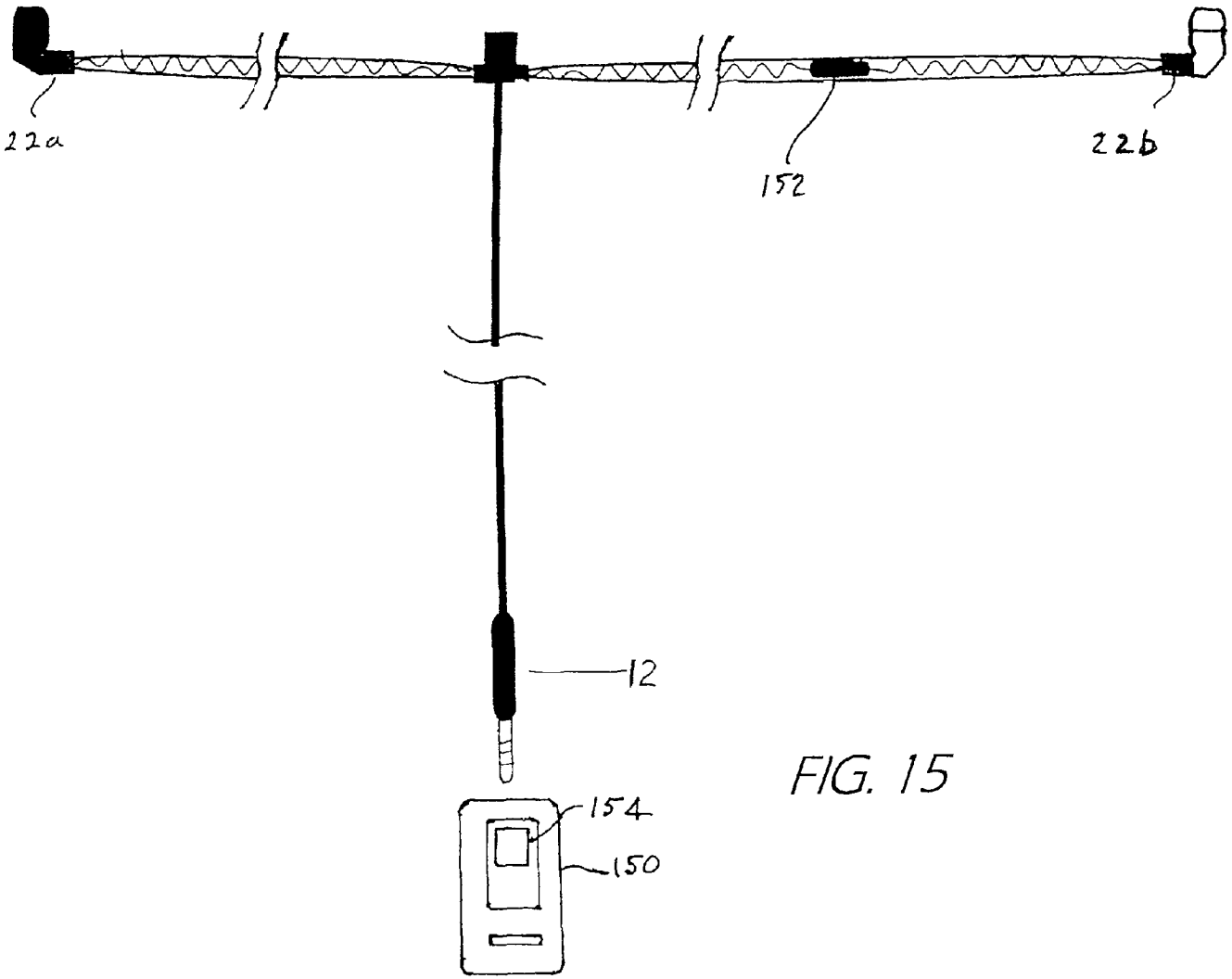
FIG. 15 is another embodiment of the invention.

Another embodiment is shown in FIG. 15 in which the lanyard assembly is further developed for a Bluetooth receiver/transmitter 150. In this embodiment, the connector 12 is connectable to a Bluetooth receiver/transmitter 150. One of the wires 14*a*' or 14*b*' has a microphone 152 connected to it which has an internal pressure switch. The Bluetooth receiver/transmitter 150 is equipped with an on-off switch 154 and other electronic elements common to such devices. The user simply connects the Bluetooth device 150 and can listen to any incoming recorded message or to a live person and can respond by turning on and using the microphone 152. When the lanyard assembly is used for just listening such as to music via an MP3 player or the like the same wiring performs as described above.

Another embodiment of the invention is described with reference to FIGS. 16, 17 and 18.

This embodiment is based on special requirements for children. For children it is not desirable and may be prohibited to allow any means for cinching the hood due to the danger of choking from any dangling cord such as a lanyard or in the case of the present combination from any exposed wiring. The following describes an embodiment of the invention in which there is no lanyard or other cinching means, but does have the built-in wiring and speakers; all the wiring being contained against access or exposure that would create a danger. Also, securing tabs are used at specific points so that the hood cannot be cinched even if the wire is pulled from its accessible end and also to secure the speakers in a selected place in the hood on its right and left sides respectively. The wire from each speaker extends into a hood channel along the hood opening and then into a tube secured to the garment body. The wires can enter the hood channel at any desired selected place. However it is desirable that they enter together and preferably at the center of the hood where the hood seam and the channel stitch line intersect so that it is convenient to leave a space at which the wires enter the hood channel together. The tube is openly secured at the line of joinder of the hood and the body so that the wires pass from the hood channel into the tube with no external exposure or access. A securing tab is installed in the hood at a point proximate to where the wires leave the hood channel and go into the tube. The securing tab is fixed around the wires such as by gluing and is fixed in place by being commonly sewn in the stitch that defines the hood channel. There is a pair of second securing tabs, each one installed proximate one of the speakers. Each of the second securing tabs is fixed around the wire proximate the speaker and is fixed in place by common sewing with the patch that defines the pocket. This helps to hold the wire and the speaker in a relatively fixed position. Also, a protective pad is installed behind each speaker to protect the speakers from shock or other damage such as from a washer or dryer, or simply from being inadvertently struck from outside the hood. The protective pad can be a non-woven fabric such as felt, with sufficient thickness to provide some level of protection, such as 1/32 to 1/4 inch thick. It is held in place by being commonly sewn with the patch.

Figure 16:
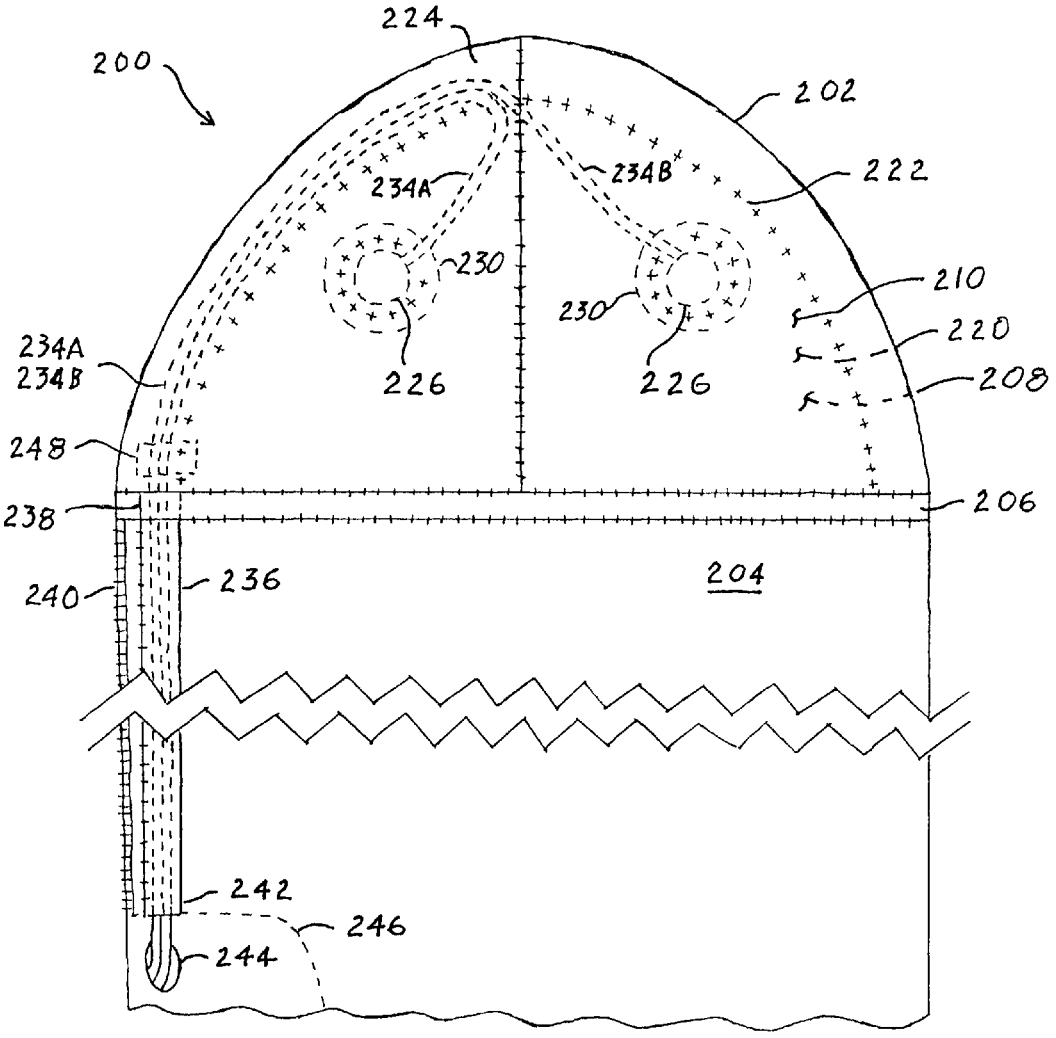
FIG. 16 is an embodiment of the invention that is specially configured for garments for children.
Figure 17:
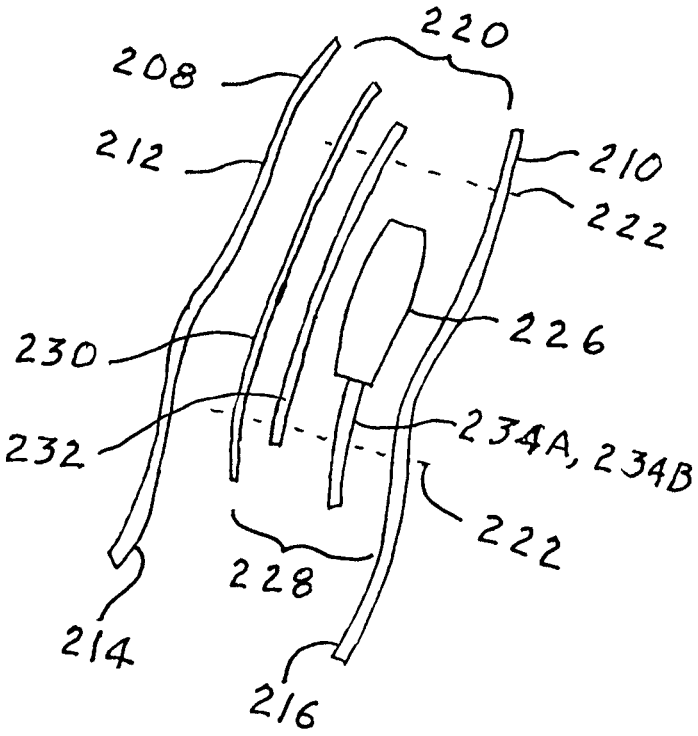
FIG. 17 is a partial exploded view of the configuration of FIG. 16.

FIG. 16 shows an open view of the subject garment. FIG. 17 is an exploded view of the speaker pocket construction. FIG. 18 shows detail of the speaker pocket construction and the securing tab installation. Referring to FIGS. 16, 17 and 18 the garment 200 has a hood portion 202 and body portion 204 which are sewn to together along a line of joinder 206. The hood portion 202 is made with an outside panel 208 and a liner panel 210. The outside panel 208 has an outer surface 212 which is the exterior of the hood portion 202 and an inner surface 214. The liner panel 210 has an outer surface 216 which faces the outside panel 208 to define a space 220 between the two panels. A stitch line 222 creates a hood channel 224 within the space 220. In the space 220, at a point selected to fit at or near a user's ears are speakers 226.

Each speaker 226 is secured in a speaker pocket 228 which is made by stitching onto the liner panel 210 a patch 230. Also, a protective sheet 232 is desirably installed in the speaker pocket 228 on the side of each speaker 226 facing outwardly. For example the protective sheet 232 can be a nonwoven such as felt and can have thickness in the range of about 1/32 to about 1/4 inch. The protection will be provided from the hood portion 202 being struck from the outside or from a washing machine or dryer.

Wires 234A and 234B extend from the each of the speakers 226 respectively in the space 220 and into the hood channel 224. While the wires 234A and 234B can enter the hood channel 224 separately and at any selected place it is desirable that they enter together and also that they enter at a place where a space in the stitching 222 of the hood channel 224 can be allowed an opening so that they may pass through. This is advantageously done at the center of the hood where a central seam 236 of the liner panel 210 occurs. The wires 234A and 234B then extend as a pair in the hood channel 224 to the line of joinder 206 where they pass into the tube 236. The tube 236 is installed at its top end 238 at the seam of the line of joinder 206 but the stitching is done so that the tube 236 is open into the hood channel 224. In that way the paired wires 234A and 234B can pass into the tube 236 with no outside exposure or access. The tube 236 is attached along its length down the body portion 204 by common stitching with installation of a zipper 240 and terminates at a bottom end 242 as near as practical to an opening 244 into pocket 246 (see pocket 32 in FIG. 3). The opening 244 is desirably a button hole or a grommet. As described above in other embodiments, the paired wires 234A and 234B are terminated to a connector (see connector 12 in FIG. 3) which is accessible into the pocket 246, from outside the garment.

As seen in FIG. 16, in the hood channel 224, close to the line of joinder 206 a securing tab 248 is fixed to the paired wires 234A and 234B It can be fixed by gluing or other means. The securing tab 248 is commonly stitched with the stitching 222 that forms the hood channel 224. The securing tab 248 will prevent any strain from pulling on the paired wires 234A, 234B thereby preventing any cinching of the hood portion 202.

Figure 18:
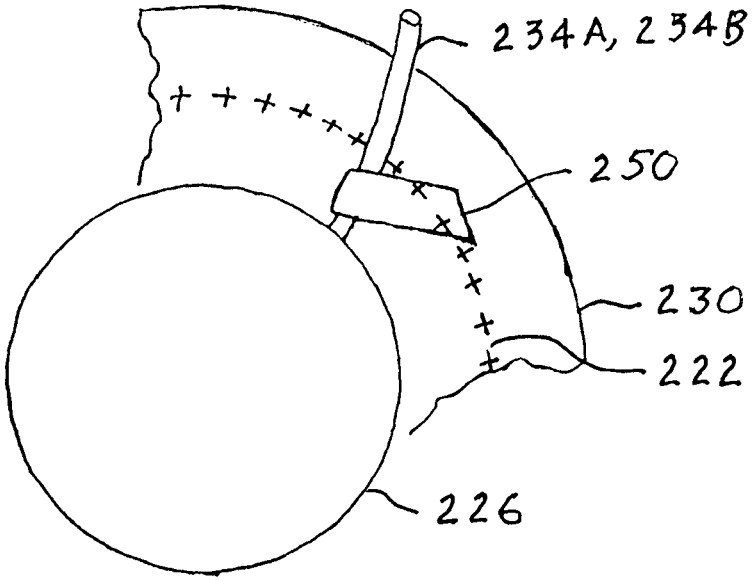
FIG. 18 is a partial view of the configuration of FIG. 16.

As seen in the magnified view of FIG. 18, there is a securing tab 250 fixed on each of wire 234A and 234B as it is attached to the respective speaker 226 and is commonly stitched with the patch 230 along stitching 222. The securing tab 250 then prevents any strain on the respective wire from being transmitted to its point of attachment to the speaker, and also helps steady the speaker in position in the speaker pocket 228.

Figure 19:
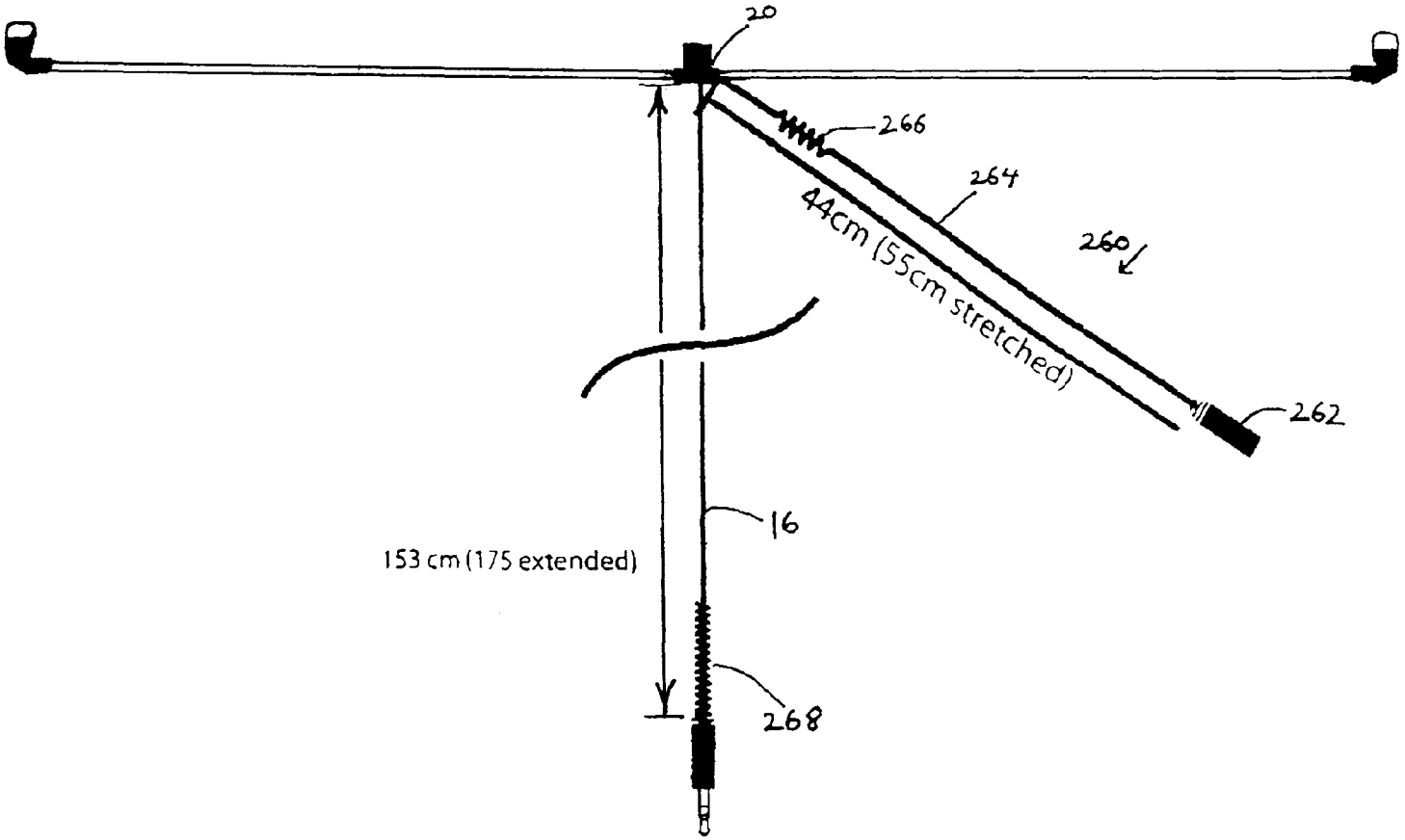
FIG. 19 is a wiring diagram of an alternative in which a connection wire is provided having a female jack to allow a second person to listen.

FIG. 19 shows an alternative wiring 260 in which a "companion" female jack 262 is connected by the auxiliary wire 264 to the transmission wiring 14*a* and 14*b* at and secured by the strain relief member 20. It then extends down the hood channel or casing 38 and exiting making it accessible to connect to another set of earplugs or to earphones. It therefore allows the primary user to use earphones instead of the earplugs, or to share the source with a companion using earplugs or an earphone. The alternative wiring can be of a type having a biased coil 266 so that it can be extended and will then retract. Also, the transmission wiring 16 is equipped with biased coil 268 so that it can be extended and will retract. Exemplary lengths of the coil biased wires as shown are the retracted and extended lengths.

Figure 20:
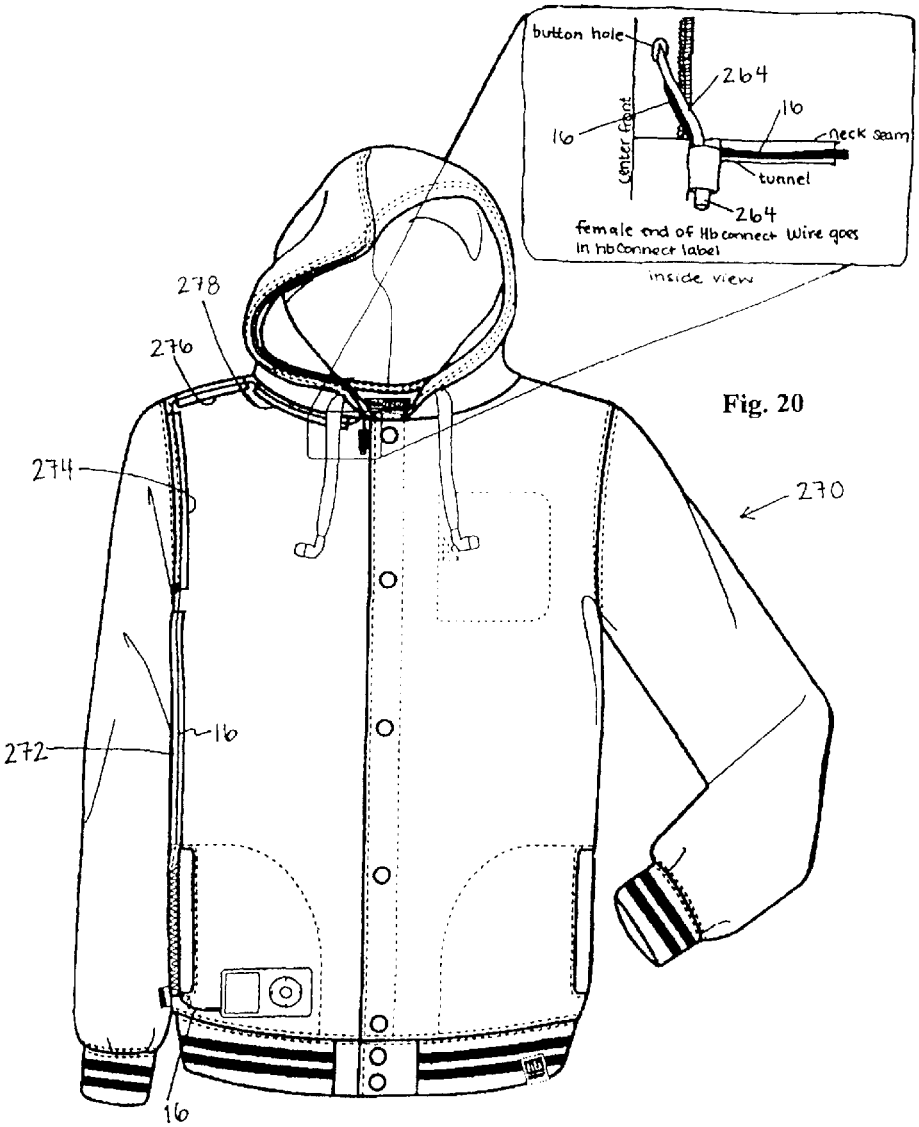
FIG. 20 is an alternative embodiment showing an alternative routing of the joined wire portion into the hood channel.

FIG. 20 shows an alternative embodiment for bringing the joined portion 16 of the transmission wiring from the pocket 32 into the hood channel 38. This is done by tubing portions sewn into seams of the garment 270. In FIG. 20, the tubes are illustrated in solid lines, but actually are not seen on the outside of the garment because they are inside the garment on certain seams of the garment 270. This is seen in FIG. 20 as the joined portion 16 passes through an opening in the pocket 32 into the interior of the garment 270. The joined portion 16 proceeds up a tube (typically made of cloth) 272 sewn into the side seam of the garment, then into another tube 274 sewn into the sleeve seam of the garment and then into another tube 276 sewn into the shoulder seam of the garment and then through another tube 278 sewn into the neck seam of the garment. The transmission wire 16, then passes into the hood channel as described above.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. This disclosure has been made with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising step(s) for . . . . "

The invention claimed is:

1. A combination of a garment and wiring for an audio source device along with an auxiliary connection for additional or different listening comprising:

a garment having an opening portion and a channel extending from proximate a left to a right side of the opening portion; and audio connection wiring comprising a source access connector and having a first portion pair of wires defining transmission wiring, extending from the connector which first portion pair of wires are joined, up to a separation point at which the pair of wires separate into separate left and right wires terminating in respective left and right earphones;

the audio connection wiring being assembled into the garment so that the connector is available at a selected location for connecting to an audio source device;

the separation point being inside the channel and the separate left and right wires exiting the channel each having a length outside the channel terminating in the respective left and right earphones; and a strain relief member provided around the wires at the separation point securing the wires against unintended separation;

an additional wiring connected to the transmission wiring pair of wires at the separation point and within the strain relief, the additional wiring exiting the channel at one of the left or right side of the opening portion and having a jack at an accessible end outside the channel for connecting a listening apparatus;

whereby an audio source device may be attached at the connector and the earphones may be inserted into a user's ears and the wiring is protected against unintended separation of the wires within the channel and an additional audio listening apparatus source may be connected to the additional wiring enabling alternative listening apparatus to be used.

2. The combination of claim 1 further comprising a securing member attached to the strain relief member and also attached to the garment thereby to prevent lateral movement of the wires inside the channel.

3. The combination of claim 2 wherein the securing member is a fabric strip fixed to the strain relief member and being co-sewn into a hem stitch which defines the channel.

4. The combination of claim 1 wherein the strain relief member is a plastic barrel applied around the wires at the separation point.

5. The combination of claim 4 further comprising a securing member comprising a fabric strip adhesively attached to the plastic barrel and also attached to the garment by being co-sewn into a hem stitch which defines the channel thereby to prevent lateral movement of the wires inside the channel.

6. The combination of claim 1 wherein the opening portion is a collar of the garment and the channel extends around the collar.

7. The combination of claim 1 wherein the opening portion comprises a hood for cinching and further comprising a hollow left and right lanyard inside which each of the left and right wires extend respectively, each lanyard being attached at an entry end to the strain relief member and terminating at the each earphone.

8. The combination of claim 7 wherein the lanyards are of a flexible resilient material.

9. The combination of claim 7 further comprising a securing member attached to the strain relief member and also attached to the garment thereby to prevent lateral movement of the wires inside the channel.

10. The combination of claim 9 wherein the securing member is a fabric strip fixed to the strain relief member and being co-sewn into a hem stitch which defines the channel.

11. The combination of claim 7 wherein the strain relief member is a plastic barrel applied around the wires at the separation point.

12. The combination of claim 11 further comprising a securing member comprising a fabric strip adhesively attached to the plastic barrel and also attached to the garment by being co-sewn into a hem stitch which defines the channel thereby to prevent lateral movement of the wires inside the channel.

13. The combination of claim 7 wherein the opening portion is a collar of the garment and the channel extends around the collar.

14. A combination of a garment and wiring for an audio source device along with an auxiliary connection for additional or different listening comprising:

a garment having an opening portion and a channel extending from proximate a left to a right side of the opening portion; and audio connection wiring comprising a source access connector and having a first portion pair of wires defining transmission wiring, extending from the connector which first portion pair of wires are joined, up to a separation point at which the pair of wires separate into separate left and right wires terminating in respective left and right earphones;

the audio connection wiring being assembled into the garment so that the connector is available at a selected location for connecting to an audio source device;

the separation point being inside the channel and the separate left and right wires exiting the channel each having a length outside the channel terminating in the respective left and right earphones; and a strain relief member provided around the wires at the separation point securing the wires against unintended separation;

the transmission wiring extending from an audio source connector exteriorly accessible in a pocket and through an opening of the pocket to the garment interior and then through a tube sewn into a side seam of the garment, and then into another tube sewn into a sleeve seam and then into another tube sewn into a shoulder seam and then into the channel;

whereby an audio source device may be attached at the connector and the earphones may be inserted into a user's ears and the wiring is protected against unintended separation of the wires within the channel.

15. The combination of claim 14 further comprising:

an additional wiring connected to the transmission wiring pair of wires at the separation point and within the strain relief, the additional wiring exiting the channel at one of the left or right side of the opening portion and having a jack at an accessible end outside the channel for connecting a listening apparatus;

whereby an additional audio listening apparatus source may be connected to the additional wiring enabling alternative listening apparatus to be used.

16. The combination of claim 14 wherein the opening portion comprises a hood for cinching and further comprising a hollow left and right lanyard inside which each of the left and right wires extend respectively, each lanyard being attached at an entry end to the strain relief member and terminating at the each earphone.

17. The combination of claim 16 wherein the lanyards are of a flexible resilient material.

18. The combination of claim 14 further comprising a securing member attached to the strain relief member and also attached to the garment thereby to prevent lateral movement of the wires inside the channel.

19. The combination of claim 18 wherein the securing member is a fabric strip fixed to the strain relief member and being co-sewn into a hem stitch which defines the channel.

20. The combination of claim 14 wherein the strain relief member is a plastic barrel applied around the wires at the separation point.

21. The combination of claim 20 further comprising a securing member comprising a fabric strip adhesively attached to the plastic barrel and also attached to the garment by being co-sewn into a hem stitch which defines the channel thereby to prevent lateral movement of the wires inside the channel.

22. The combination of claim 14 wherein the opening portion is a collar of the garment and the channel extends around the collar.

* * * * *